US009622564B2

(12) United States Patent
Caulier et al.

(10) Patent No.: US 9,622,564 B2
(45) Date of Patent: Apr. 18, 2017

(54) COSMETIC APPLICATOR

(75) Inventors: Eric Caulier, Maignelay (FR); Marine Roualdes, Paris (FR)

(73) Assignee: L'OREAL, Paris (FR)

( * ) Notice: Subject to any disclaimer, the term of this patent is extended or adjusted under 35 U.S.C. 154(b) by 0 days.

(21) Appl. No.: 14/342,588

(22) PCT Filed: Aug. 28, 2012

(86) PCT No.: PCT/IB2012/054412

§ 371 (c)(1),
(2), (4) Date: Jul. 16, 2014

(87) PCT Pub. No.: WO2013/030766

PCT Pub. Date: Mar. 7, 2013

(65) Prior Publication Data

US 2014/0360521 A1 Dec. 11, 2014

(30) Foreign Application Priority Data

Sep. 1, 2011 (FR) ..... 11 57741

(51) Int. Cl.
*A45D 40/26* (2006.01)
*A45D 34/04* (2006.01)
(Continued)

(52) U.S. Cl.
CPC ..... *A45D 40/262* (2013.01); *A45D 34/043* (2013.01); *A45D 40/267* (2013.01);
(Continued)

(58) Field of Classification Search
CPC .. A45D 34/042; A45D 34/043; A45D 34/045; A45D 34/046; A45D 40/262;
(Continued)

(56) References Cited

U.S. PATENT DOCUMENTS 5,934,292 A 8/1999 Gueret
5,937,870 A 8/1999 Gueret
(Continued)

FOREIGN PATENT DOCUMENTS

CN 1187964 A 7/1998
CN 1191706 A 9/1998
(Continued)

OTHER PUBLICATIONS

Jan. 7, 2013 Search Report issued in International Patent Application No. PCT/IB2012/054412.
(Continued)

*Primary Examiner* — Tatiana Nobrega
(74) *Attorney, Agent, or Firm* — Oliff PLC

(57) ABSTRACT

Disclosed is an applicator for applying a cosmetic product to the eyelashes or eyebrows, including: a stem extending along a longitudinal axis; an applicator member located at a distal end of the stem, that includes: a core extending along a longitudinal axis, bristles connected to the core, defining an envelope surface, the applicator member having a proximal part and a distal part; the envelope surface having a notch with a profile, as seen in longitudinal section, that is not symmetrical with respect to any plane perpendicular to the longitudinal axis of the core; and the envelope surface having, in the proximal part, a variable cross section that decreases in size towards the distal part, the largest transverse dimension of the envelope surface in the distal part being smaller than the largest transverse dimension of the envelope surface in the proximal part.

21 Claims, 3 Drawing Sheets

Figure 1:
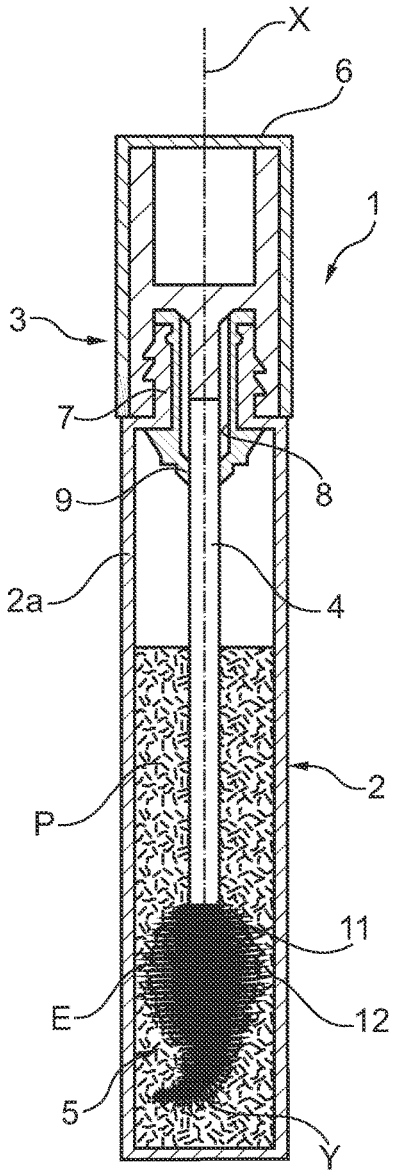

(51) Int. Cl.
*A46B 3/00* (2006.01)
*A46B 9/02* (2006.01)

(52) U.S. Cl.
CPC ..... *A46B 3/005* (2013.01); *A46B 9/021* (2013.01); *A46B 9/026* (2013.01); *A46B 9/028* (2013.01); *A46B 2200/1053* (2013.01)

(58) Field of Classification Search
CPC .. A45D 40/264; A45D 40/265; A45D 40/267; A46B 2200/1046; A46B 2200/4053; A46B 3/005; A46B 9/02; A46B 9/021; A46B 9/025; A46B 9/026; A46B 9/028; A46B 2200/40531
USPC ..... 132/216, 218, 320; 401/129
See application file for complete search history.

(56) References Cited

U.S. PATENT DOCUMENTS

| | | | | |
|---|---|---|---|---|
| 6,280,112 | B1 | 8/2001 | Vieu | |
| 6,532,967 | B1 | 3/2003 | Dumler | |
| 8,210,763 | B2 * | 7/2012 | Gueret | 401/129 |
| 2002/0124861 | A1 | 9/2002 | Gueret | |
| 2002/0139385 | A1 | 10/2002 | Gueret | |
| 2003/0089379 | A1 | 5/2003 | Gueret | |
| 2004/0009028 | A1 * | 1/2004 | Gueret | 401/129 |
| 2007/0079845 | A1 * | 4/2007 | Gueret | 132/218 |
| 2010/0003065 | A1 | 1/2010 | Haan | |
| 2010/0288296 | A1 * | 11/2010 | Takata et al. | 132/218 |
| 2011/0083693 | A1 | 4/2011 | Gueret | |
| 2011/0129286 | A1 * | 6/2011 | Gueret | 401/122 |
| 2012/0174941 | A1 * | 7/2012 | Gueret | 132/218 |

FOREIGN PATENT DOCUMENTS

| | | | | |
|---|---|---|---|---|
| CN | 1374053 | A | 10/2002 | |
| CN | 1374054 | A | 10/2002 | |
| CN | 101836790 | A | 9/2010 | |
| EP | 1 005 806 | A1 | 6/2000 | |
| JP | 2001286340 | A | 10/2001 | |
| JP | 2007-307311 | A | 11/2007 | |
| WO | WO 9316617 | A1 * | 9/1993 | A46B 3/18 |
| WO | WO 2010/007588 | A2 | 1/2010 | |
| WO | WO 2010007588 | A2 * | 1/2010 | A45D 40/26 |

OTHER PUBLICATIONS

Jan. 7, 2013 Written Opinion issued in International Patent Application No. PCT/IB2012/054412.
Dec. 31, 2014 Office Action issued in Chinese Patent Application No. 201280041785.6.
Aug. 29, 2016 Office Action issued in Japanese Patent Application No. 2014-527785.

* cited by examiner

COSMETIC APPLICATOR

The present invention relates to applicators intended for the application of a cosmetic product to the eyelashes or eyebrows, also known as mascara brushes.

A mascara brush has to make it possible to apply product to the eyelashes without sticking the eyelashes together. The brush should thus also be able to effectively separate the eyelashes.

Brushes having very different shapes have been proposed with the aim of obtaining both satisfactory makeup application properties and satisfactory separation properties.

Brushes which have a twisted core and are curved at their end are known from documents U.S. Pat. No. 6,532,967, US 2010/0003065, EP 0 832 580 and FR 2 821 532.

Injection-moulded and curved applicators are also known from applications FR 2 831 033, FR 2 786 674 and FR 2 821 532.

The utility certificate FR 2 920 649 describes an injection-moulded brush having a different number of elements projecting from two faces.

There is a need to further improve mascara brushes, and in particular to reach a satisfactory compromise between the separating capability of the brush and its makeup application capability. Moreover, the brush should be able to be produced easily and used without particular precautions having to be taken by the user.

The invention aims to respond at least in part to this need and, according to one of its aspects, achieves this by virtue of an applicator for applying a cosmetic product to the eyelashes or eyebrows, comprising:

- a stem extending along a longitudinal, preferably rectilinear, axis,
- an applicator member located at a distal end of the stem, comprising:
  - a core extending along a longitudinal axis,
  - bristles connected to the core, the free end of the bristles defining an envelope surface, the applicator member having a proximal part and a distal part, the envelope surface having a notch with a profile, as seen in longitudinal section, that is advantageously not symmetrical with respect to any plane perpendicular to the longitudinal axis of the core, and the envelope surface having, in the proximal part, a variable cross section that decreases in size towards the distal part, the largest transverse dimension of the envelope surface in the distal part being smaller than the largest transverse dimension of the envelope surface in the proximal part.

The transverse dimension of the envelope surface is measured between two points of the envelope surface that are diametrically opposite and are at the same axial position along the core, the envelope surface being defined on the outside by the free ends of the bristles.

The notch is bounded on the inside by the contour of the envelope surface and on the outside by a tangent to the envelope surface in the plane of observation when the applicator is viewed in a direction perpendicular to the longitudinal axis of the stem. This tangent may be parallel to the longitudinal axis of the stem.

The invention applies both to brushes having attached bristles and to those having bristles moulded in one piece with the core and both to brushes having a rectilinear core and to those having a curved core.

By virtue of the invention, different makeup effects are possible with the same applicator. The applicator has different application regions on one and the same applicator member, making it possible, for example, for more product to be applied to the eyelashes at the end of the row of eyelashes or for the eyelashes to be separated effectively.

The notch forms a concavity which can hold product. There is preferably a single concavity. The profile of the notch may have only two points of inflection. When the applicator according to the invention is part of a device having a container into which the applicator member is inserted to be loaded with product, on removal from the container the recess of said notch is wiped less well by the wiping member. This region of the applicator member can be used to apply more product to the eyelashes. The back of the applicator member, opposite said notch, makes it possible in turn to reach certain eyelashes that are difficult to reach, such as the bottom eyelashes, and to separate them effectively.

The longitudinal axis of the core may have a non-constant curvature along the entire portion carrying the bristles or alternatively extend along a rectilinear longitudinal axis.

The expression "non-constant curvature along the entire portion carrying the bristles" should be understood as meaning that the portion carrying the bristles is not entirely rectilinear and has a longitudinal axis that is not entirely coincident with a circular arc of constant radius.

When the core is curved, the curvature given to the core may be involved in the formation of the notch. When the core is rectilinear, the notch is for example produced by machining a blank or by moulding the applicator member with a shape having the notch.

The distal part preferably corresponds to the region that extends from the distal end of the core to the bottom of the notch, the bottom of the notch designating the region where the distance from the envelope surface to the core is at its smallest. This distance may be zero, if need be, in the absence of bristles. The distal part may represent less than half the length of the part of the applicator member carrying the bristles, measured along the longitudinal axis of the core.

The bottom of the notch may be closer to the distal end of the core than to the proximal end.

In the case where the curvature of the core is non-constant, said core is preferably rectilinear in the proximal part, having a longitudinal axis coincident with the longitudinal axis of the distal part of the stem.

The core may be curved in the distal part, the axis of the core undergoing for example a change of orientation of at least 45°, preferably at least 90°. The core may be folded on itself, such that the distal part of the applicator member forms a hook.

The core of the applicator member may be a twisted core formed by two metal strands that are twisted together, these two strands being produced conventionally by a wire folded on itself. The core may be flexible and non-metallic, in particular when the longitudinal axis of the core is not rectilinear.

Thus, the core can be produced from a fairly flexible material, such as an elastomer, so as not to get caught on the wiping member upon removal from the container. During removal from the container, the core can deform, if need be, and then return to its original shape by elasticity.

The bristles may be attached to the core or, preferably, moulded in one piece therewith, from the same material or a different material. The bristles may be different depending on their position on the core. For example, when the bristles are moulded, they may have different heights and/or sections depending on their position on the core.

The longitudinal axis of each bristle may be oriented approximately perpendicularly to the longitudinal axis of the core, at the base where it is connected to the core. Thus, when the curvature of the core is non-constant, the bristles turned towards the notch may have free ends that are closer together than outside the notch, while retaining the same spacing at their bases. On the side opposite the notch, the bristles are spaced further apart at their ends, and this can make the action of separating the eyelashes easier.

If need be, the bottom of the notch may have no bristles or have a smaller number thereof.

The bristles located in one and the same longitudinal position on the core may all have the same length. Alternatively, some bristles may be shorter than others, thereby making the core of the applicator member non-centred with respect to the section of the envelope surface when said applicator member is viewed in cross section. These shorter bristles may define the notch.

The cross section of the envelope surface defined by the free end of the bristles may have a circular, elliptical or polygonal, for example triangular, shape.

The envelope surface may have a cross section which decreases continuously towards the distal part, starting from the largest section of the proximal part of the envelope surface.

The length of the part of the applicator member carrying bristles may be between 15 mm and 30 mm, being for example between 25 and 30 mm, for example equal to 27 mm.

The envelope surface may take on its final shape after machining of the applicator member or, alternatively, the applicator member may be moulded with its final shape. It is also possible to mould the applicator member and/or machine it and then deform the core and/or the bristles, by way of heat if necessary, in order to curve the distal part and/or reduce the length of the bristles.

The applicator member may alternatively be given its final shape by moulding the applicator member with a hollow and rectilinear shape, for example, and then introducing an insert into the applicator member. This insert is for example made of an elastically deformable metal having shape memory, made of plastics material, or is more rigid, made of metal and malleable. Optionally, the insert is introduced with its final curvature.

When the core has a non-constant curvature, the distal end of the core is preferably located on the same side as the notch, this side being bounded by a plane containing the longitudinal axis of the stem.

The envelope surface may pass through a single cross-sectional maximum which is preferably located in the first half of the applicator member starting from the proximal end of the portion carrying the bristles, preferably approximately half-way along this first half, in particular between a quarter and three quarters of the length of this first half.

When it is not entirely rectilinear, the longitudinal axis of the core may undergo a change in orientation, starting from the proximal end of the part of the applicator member carrying the bristles, always in the same direction, thereby ruling out an undulating shape of the core.

Preferably, the longitudinal axis of the core is entirely contained in a single plane. The distance from the free end of the core to the longitudinal axis of the stem, extending the distal end of the stem, is preferably less than half the largest transverse dimension of the envelope surface, or is less than or equal to the radius of the stem.

A further subject of the invention is a device for the application of a cosmetic product to the eyelashes or eyebrows, comprising:

a container containing the product, and an applicator as defined previously.

The container may have any shape.

The container is advantageously equipped with a wiping member, which may be of any type, is connected to the container or moulded in one piece therewith and is optionally adjustable.

The wiping orifice may be approximately circular, adapted to the diameter of the stem and/or have radial or tangential slots.

A further subject of the invention is a method for making up the eyelashes or eyebrows, in which the product is applied to the eyelashes or eyebrows with the aid of a device according to the invention. In particular, application to the eyelashes at the ends of the row may be carried out with the distal part of the applicator member.

A further subject of the invention, according to another of its aspects, is an applicator for applying a cosmetic product to the eyelashes or eyebrows, comprising:

a stem extending along a longitudinal axis, an applicator member located at a distal end of the stem, comprising:

a core extending along a longitudinal axis, bristles connected to the core, defining an envelope surface, the applicator member having a proximal part and a distal part, the envelope surface having, in the proximal part, a variable cross section that decreases in size towards the distal part, the largest transverse dimension of the envelope surface in the distal part being smaller than the largest transverse dimension of the envelope surface in the proximal part, the longitudinal axis of the core having a non-constant curvature along the entire portion carrying the bristles.

Such an applicator, according to this other subject of the invention, may have at least one of the above features, except for a core having an entirely rectilinear longitudinal axis.

Figure 2:
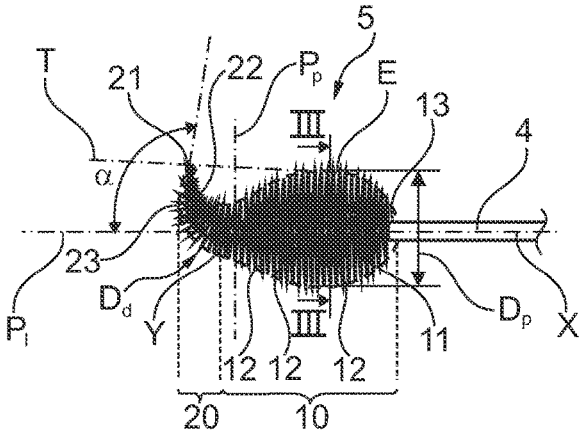
Figure 3:
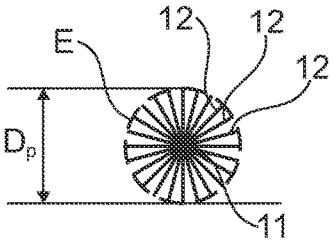
Figure 5:
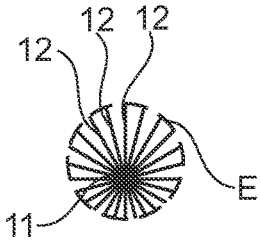
Figure 4:
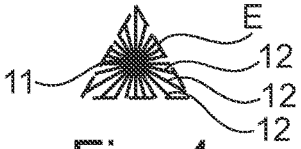
Figure 6:
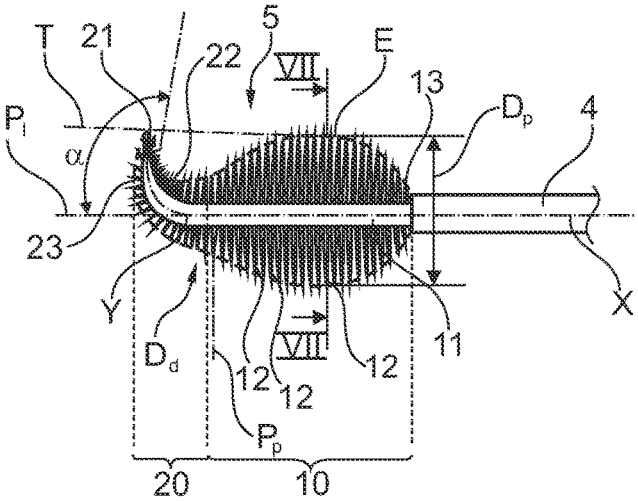
Figure 7:
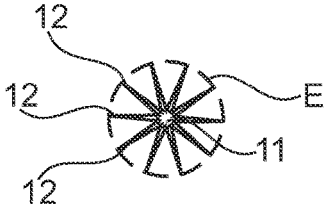
Figure 8A:
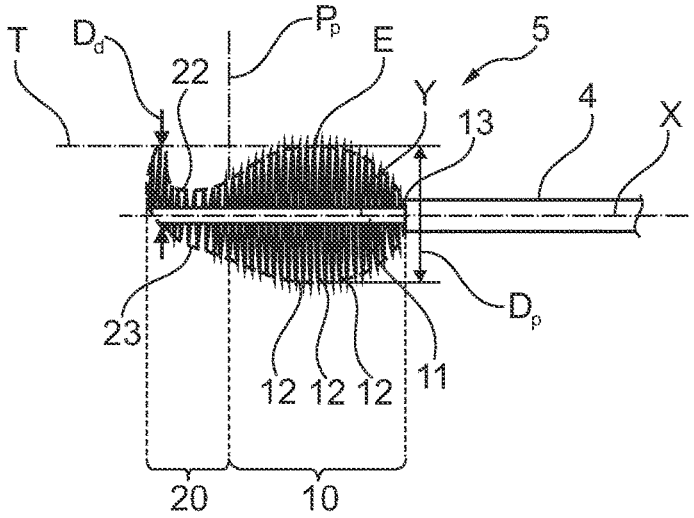
Figure 8B:
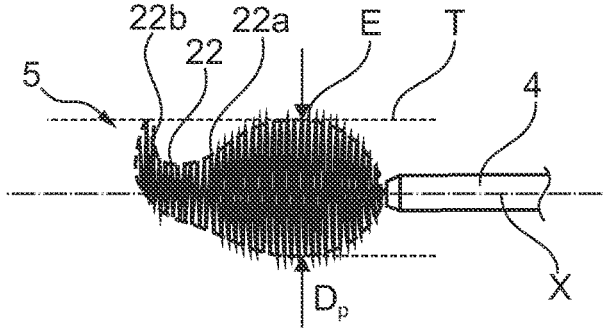
Figure 10A:
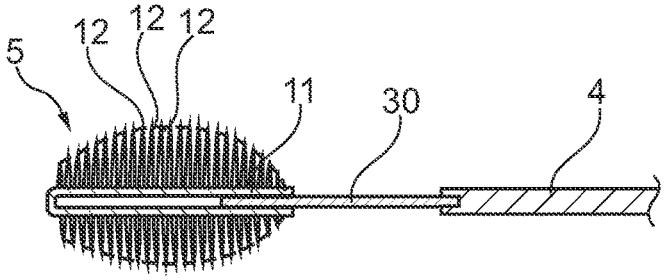
Figure 10B:
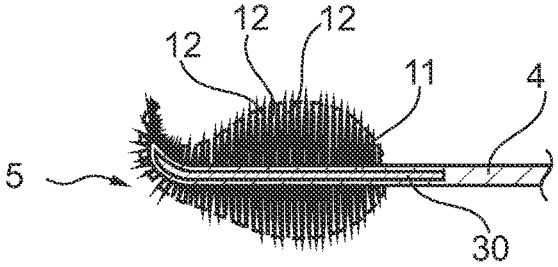
Figure 9A:
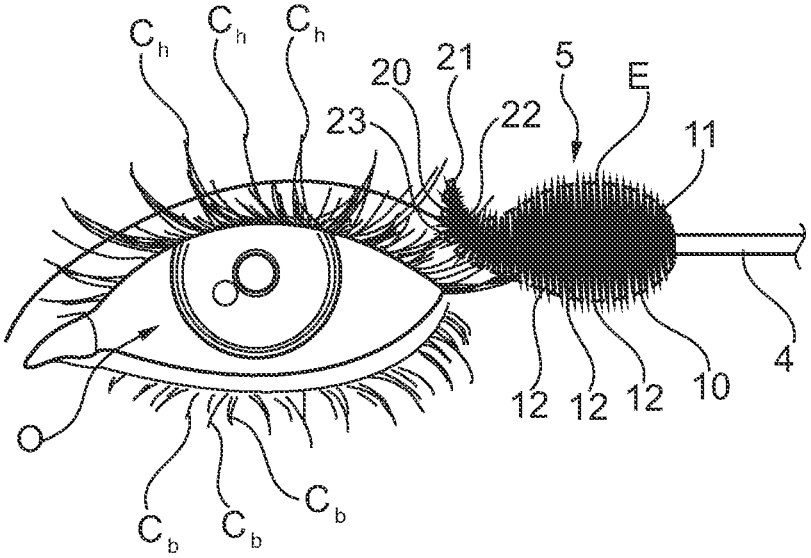
Figure 9B:
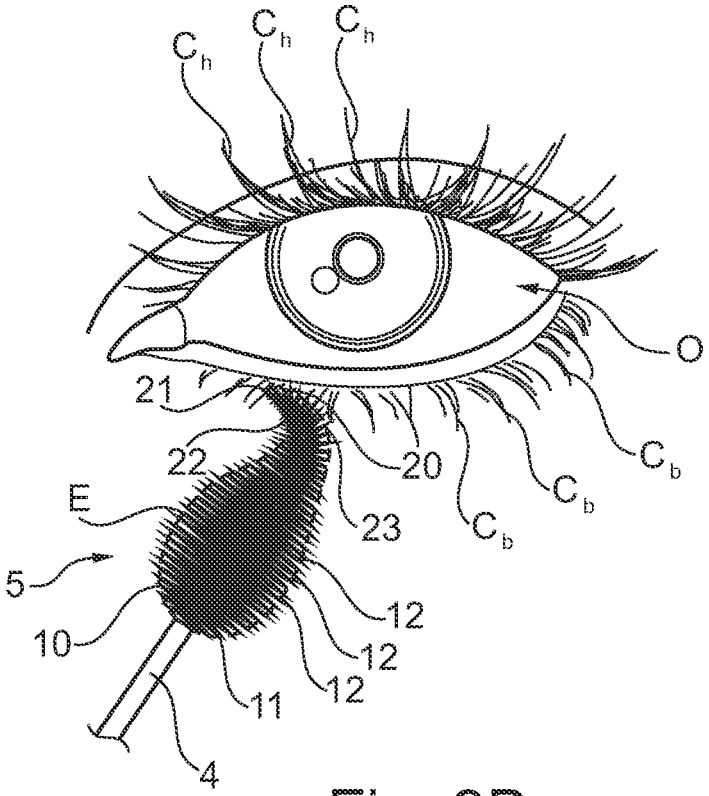

The present invention may be better understood from reading the following detailed description of non-limiting implementation examples thereof, and with reference to the attached drawing, in which:

FIG. 1 is a schematic view, in partial longitudinal section, of an exemplary packaging and application device produced in accordance with the invention, FIG. 2 shows the applicator member of the device from FIG. 1 on its own, FIG. 3 is a cross section along III-III in FIG. 2, FIGS. 4 and 5 are views similar to FIG. 3 of variant examples of applicator members, FIG. 6 is a view similar to FIG. 2 of a variant applicator member according to the invention, FIG. 7 is a cross section along VII-VII of the applicator member in FIG. 6, FIGS. 8A and 8B are views similar to FIG. 6 of variant applicator members according to the invention, FIGS. 9A and 9B illustrate the use of an applicator according to the invention, and FIGS. 10A and 10B illustrate a way of producing an applicator member according to the invention.

The packaging and application device 1 shown in FIG. 1 has a container 2 containing a cosmetic product P, for example mascara, and an applicator 3 which may, as illustrated, be fixed to the container 2 in order to close the latter when not in use.

The applicator 3 has a stem 4 which is connected at a proximal end to a gripping member 6 which also forms a member for closing the container 2 in a sealed manner.

The stem 4 is connected at its distal end to an applicator member 5, also called a brush, which will be described in detail below.

The container 2 may comprise, as illustrated, a body 2*a*, provided with a threaded neck 7, in which there is fixed a wiping member 8 suitable for wiping the stem 4 and also the applicator member 5 when the latter is removed from the container 2.

The wiping member 8 may be of any type, connected to the container or moulded in one piece therewith. The wiping orifice may be defined by a wiping lip 9 having a rim which is or is not circular. The wiping lip may have a conical or undulating shape and/or have radial or tangential slots. The wiping lip 9 defines for example an orifice having a circular section and a diameter slightly greater than that of the stem 4. The wiping member 8 may also be adjustable. Alternatively, the neck 7 of the container 2 may be attached.

In the example illustrated, the stem 4 has a rectilinear longitudinal axis X, but if the stem 4 is not rectilinear, this does not depart from the scope of the present invention. The stem 4 may optionally have a narrowing, not illustrated, which is positioned at the wiping member 8 when the container 2 is closed. The stem 4 may have a flexible part at its distal end.

The product P is intended to be applied to the eyelashes and/or eyebrows. It may comprise iron oxide, among other pigments, and an aqueous or organic solvent, depending on the formulation.

The applicator member 5 has been schematically illustrated on its own in FIG. 2.

Said applicator member 5 has a core 11 extending along a longitudinal axis Y and a proximal part 10 and a distal part 20. In the example described, the core 11 has a non-constant curvature over the entire portion carrying the bristles 12.

The applicator member 5 has bristles 12 connected to the core 11, the free end of said bristles 12 defining an envelope surface E which has a notch 22, the profile of which, as seen in longitudinal section as in the plane of FIG. 2, is not symmetrical with respect to any plane $P_p$ perpendicular to the longitudinal axis of the core.

The distal part 20 may correspond, as illustrated, to a region of the applicator member 5 that extends from the distal end 21 of the core 11 to the bottom of the notch 22, that is to say, in the example described, to the location where the curvature of the core changes noticeably, the core changing for example from rectilinear, with an axis coincident with the longitudinal axis of the stem, to curved. The distal part 20 may represent less than half or less than a third of the length of the applicator member 5, measured parallel to the longitudinal axis of the core.

In the example in FIGS. 1 to 5, the core 11 is a twisted core. In variants, which are described in detail below, the core is moulded.

When the core 11 is twisted, use can be made of numerous types of different bristles 12 without departing from the scope of the present invention. Use can be made of bristles made of one of the following thermoplastic materials: polyester, polyamide, in particular Nylon® 6/6, Nylon® 6/12, polyolefin, etc.

The bristles 12 may or may not have the same nature, regardless of the way in which the applicator member 5 is produced.

The envelope surface E has, as illustrated, a variable cross section in the proximal part 10 of the applicator member 5, said cross section passing through a maximum and being able to decrease in size towards the distal part 20 from the location where the section is at a maximum, as can be seen in FIG. 2 in particular.

The largest transverse dimension $D_d$ of the envelope surface E in the distal part 20 is in particular always less than the largest transverse dimension $D_p$ of the envelope surface E in the proximal part 10, as is illustrated in FIG. 2. The largest transverse dimension $D_d$ of the envelope surface E in the distal part 20 is for example less than or equal to 8 mm and greater than or equal to 4 mm, and the largest transverse dimension $D_p$ of the envelope surface E in the proximal part 10 is for example greater than or equal to 6 mm and less than or equal to 12 mm.

The largest transverse dimension of the envelope surface E is measured between two points that are diametrically opposite and are located at the same longitudinal position on the longitudinal axis Y of the core 11, in a plane $P_p$ perpendicular to the longitudinal axis of the core.

The largest transverse dimension of the envelope surface E may be located, as illustrated, in the first half of the length of the applicator member 5, starting from the proximal end 13 of the portion carrying the bristles 12.

The envelope surface E may have, as illustrated, a cross section which decreases continuously towards the distal part 20 starting from the cross-sectional maximum of the proximal part.

The cross section of the envelope surface E may have a circular shape, as illustrated in FIG. 3. Alternatively, the cross section of the envelope surface E may be polygonal, for example triangular as in the example in FIG. 4.

In a variant in FIG. 5, the core 11 is not centred. The centre of mass of the section does not coincide with the longitudinal axis of the core. Bristles 12 are thus shorter on one side of the core than on the other.

On account of the manufacture of the applicator member 5, in the case of a curved core 11, the longitudinal axis of each bristle 12 starting from the core is approximately perpendicular to the longitudinal axis Y, as is illustrated in FIG. 2. As a result, the bristles located on the side opposite the notch are spaced further apart from one another, allowing better separation of the eyelashes and greater precision on application.

The longitudinal axis Y of the core 11 is, in the example illustrated, rectilinear in the proximal part 10.

The core 11 undergoes a change of orientation by an angle $\alpha$ of at least 30°, preferably at least 45°, preferably at least 60°, and more preferably at least 90° between the part of rectilinear axis and the distal end 21. When the angle $\alpha$ is greater than 90°, the core 11 is folded on itself, forming a hook.

The distal end 21 of the core 11 is located on the same side as the notch formed by the curvature of the core in the distal part 20. Throughout the distal part, the core can be located on the same side of a plane $P_l$ containing the longitudinal axis X of the stem 4 and perpendicular to the plane of FIG. 2.

The bottom of the notch 22 may have no bristles 12, as is illustrated in FIG. 6.

When the core 11 is twisted, the desired shape can be given to the applicator member 5, starting from a blank where the core is rectilinear and the envelope surface E is a cylinder of revolution, said blank being machined to give the envelope surface a variable section and to form the cross-sectional maximum of the proximal part 10. Next, the core 11 is twisted to give it the desired curve.

In implementation variants of the invention, the applicator member 5 is produced with bristles 12 moulded in one piece with the core 11, as illustrated in FIGS. 6 and 7. The applicator member 5 may be moulded with its final shape and a non-rectilinear core.

The applicator member 5 may be hollow moulded from a flexible material in order to receive an insert 30 that makes it possible to keep the core 11 in the curved configuration, as illustrated in FIGS. 10A and 10B. The insert can be made of plastics material or of metal, and be initially rectilinear and curved after its insertion. The insert can also be introduced with a curved configuration. In this case, the insert is produced for example from an elastically deformable material such as spring steel, for example, so as to be able to straighten at least partially during insertion, the insert returning to its initial curved shape after insertion.

In a variant illustrated in FIG. 8A, the core 11 extends along a rectilinear longitudinal axis Y. The applicator member is moulded in one piece with the bristles.

The notch 22 is obtained by virtue of the variable length of the bristles 12. The latter are for example all perpendicular to the longitudinal axis of the core. The latter can have an approximately constant section, for example a circular section having the same diameter.

In the variant illustrated in FIG. 8B, the core is rectilinear and twisted and the bristles are machined to form the notch 22. The machining can be carried out on a blank having an envelope surface in the form of a cylinder of revolution.

The profile obtained can have only two points of inflection 22*a* and 22*b* and the bottom can be at a tangent oriented approximately parallel to the longitudinal axis of the core. The two points of inflection 22*a* and 22*b* are located respectively on either side of the bottom 22.

In such a brush having a twisted core, the length of the part carrying the bristles is for example between 22 and 26 mm, and the largest transverse dimension $D_p$ is for example between 8 and 12 mm and is for example 10 mm.

The tangent T which bounds the notch 22 on the outside is for example parallel to the rectilinear longitudinal axis of the core.

The use of an applicator member according to the invention will now be described with reference to FIGS. 9A and 9B, although the following description is valid for the other examples illustrated.

The notch 22 in the applicator member 5 is wiped less by the wiping member 8 at the outlet from the container 2 than the rest of the applicator member, and thus proves to be more loaded with product P.

The notch 22 in the applicator member is brought into contact with the top eyelashes $C_h$, and product P is thus applied extensively thereto. Next, the back 23 of the applicator member opposite the notch 22 can be used to separate the eyelashes to which product has thus been applied, as is illustrated for the bottom eyelashes $C_b$ in FIG. 9B.

The invention is not limited to the examples that have just been described. The features of these examples can be combined as parts of variants which are not illustrated.

Whether they are attached to the core 11 or moulded in one piece therewith, the bristles 12 can comprise a material having bacteriostatic properties and/or a material that promotes slip and/or a magnetic material.

When the bristles 12 are moulded in one piece with the core 11, they can be made from the same material as or a different material from that of the core.

The applicator can be heated and/or subject to vibrations during use.

The profile of the bottom of the notch, when viewed in cross section perpendicularly to the longitudinal axis of the core, can be flat or concave towards the outside or convex towards the outside.

The expression "comprising a" should be understood as being synonymous with "comprising at least one", unless specified to the contrary.

The invention claimed is:

1. Applicator for applying a cosmetic product to the eyelashes or eyebrows, comprising:

a stem extending along a longitudinal axis, and an applicator member located at a distal end of the stem, comprising:

a core extending along a longitudinal axis, and bristles connected to the core, defining an envelope surface, the applicator member having a proximal part and a distal part, wherein:

the envelope surface has a notch with a profile, as seen in longitudinal section, that is not symmetrical with respect to any plane perpendicular to the longitudinal axis of the core, the envelope surface has, in the proximal part, a variable cross section that decreases in size towards the distal part, the largest transverse dimension of the envelope surface in the distal part being smaller than the largest transverse dimension of the envelope surface in the proximal part, and the profile of the notch has only two points of inflection and a bottom of the notch is at a tangent oriented approximately parallel to the longitudinal axis of the core, the two points of inflection being located respectively on either side of the bottom of the notch.

2. The applicator according to claim 1, the longitudinal axis of the core having a non-constant curvature along the entire portion carrying the bristles.

3. The applicator according to claim 1, the largest transverse dimension of the envelope surface being located in the first half of the length of the applicator member, starting from the proximal end of the portion carrying the bristles.

4. The applicator according to claim 1, the core being rectilinear in the proximal part.

5. The applicator according to claim 1, the core changing direction by at least 30° in the distal part.

6. The applicator according to claim 1, the core being folded on itself.

7. The applicator according to claim 1, the core being at least partly made of a flexible material.

8. The applicator according to claim 1, the core of the applicator member being twisted.

9. The applicator according to claim 1, the bristles of the applicator member being moulded as one piece with the core.

10. The applicator according to claim 1, the envelope surface having a cross section which decreases continuously towards the distal part from the location at which the cross section is at a maximum.

11. The applicator according to claim 1, the distal end of the core being located on the same side as the notch, in relation to a plane containing the longitudinal axis of the stem.

12. The applicator according to claim 1, the distance of the distal end of the core from the longitudinal axis of the stem being less than or equal to the greatest distance between the free end of a bristle and the longitudinal axis of the stem along the proximal part.

13. The applicator according to claim 1, the core extending along a rectilinear longitudinal axis.

14. The applicator according to claim 1, the bottom of the notch being closer to the distal end of the core than to the proximal end.

15. Device for the application of a cosmetic product to the eyelashes or eyebrows, comprising:

a container containing the product, the applicator as defined in claim 1.

16. Method for making up the eyelashes or eyebrows, in which a product is applied to the eyelashes or eyebrows with the aid of the applicator as defined in claim 1.

17. The applicator according to claim 4, wherein the core has an axis coincident with the longitudinal axis of the stem.

18. The applicator according to claim 5, wherein the core changes direction by at least 45°.

19. The applicator according to claim 5, wherein the core changes direction by at least 60°.

20. The applicator according to claim 7, wherein the core is made entirely of a flexible material.

21. The device according to claim 15, wherein the container is equipped with a wiping member.

* * * * *